United States Patent [19]

Cho

[11] Patent Number: 4,706,305

[45] Date of Patent: Nov. 17, 1987

[54] PROTECTIVE HEADGEAR

[75] Inventor: Soo S. Cho, Roseland, Fla.

[73] Assignee: Macho Products, Inc., Palm Bay, Fla.

[21] Appl. No.: 903,651

[22] Filed: Sep. 5, 1986

[51] Int. Cl.[4] ..... A63B 71/10

[52] U.S. Cl. ..... 2/425; 2/424; 2/417; 2/9

[58] Field of Search ..... 2/425, 411, 417, 423, 2/424, 9, 6

[56] References Cited

U.S. PATENT DOCUMENTS

| | | | |
|---|---|---|---|
| 1,886,551 | 12/1932 | Jones | 2/425 X |
| 2,777,127 | 1/1957 | Marietta | 2/424 |
| 3,327,316 | 6/1967 | Pukish, Jr. | 2/9 X |
| 3,628,191 | 12/1971 | Douglas | 2/425 X |
| 3,934,271 | 1/1976 | Rhee | 2/9 X |
| 4,222,122 | 9/1980 | Toms | 2/9 |
| 4,279,038 | 7/1981 | Brückner et al. | 2/417 X |

*Primary Examiner*—Werner H. Schroeder
*Assistant Examiner*—J. L. Olds

[57] ABSTRACT

An improved headgear conformable to the head of a wearer and capable of absorbing energy to thereby protect the wearer against blows to the head. The headgear is fabricated of foam coated with a pliable coating. The foam is shaped as a circumferential strip adapted to encompass the head of the wearer and includes a first portion extending across the wearer's forehead, a second portion extending across the back of the wearer's head and intermediate portions extending across the sides of the wearer's head. The intermediate portions couple the wide portion and narrow portion. A concave region is formed in the interior of the wide portion to create a dome-shaped air space between the back of the wearer's head and the interior of the headgear for the increased absorption of the force of a blow to the back of the head of a wearer. The headgear also includes ear protectors extending downwardly from the intermediate portions with each ear protector preferably including an enlarged opening overlaying a wearer's ear, and apertures formed in the headgear adjacent the opening for relieving air pressure when a blow is delivered to the ear portion.

7 Claims, 9 Drawing Figures

PROTECTIVE HEADGEAR

BACKGROUND OF THE INVENTION

1. Field of the Invention

The present invention relates to headgear for protecting a wearer from the force of a blow while participating in karate or other martial arts activity and, more particularly, to headgear designed to protect a wearer from the force of blows to the head, especially to the back of the head, in the event of a fall or blow as a result of slipping or being struck.

2. Description of the Prior Art

While practicing or competing in martial arts activities such as karate, one participant uses his hands, fists, arms, feet or weapons to inflict blows upon the other participant's body and head. These blows may result in an injury unless the force of the blow is lessened prior to physical contact. Such lessening may be achieved by the participants either wearing protective gear or by delivering less than full blows, i.e., pulling punches. During karate contests, points are scored for the nature and number of blows delivered. Consequently, spectator appeal of the sport as well as the test of participant skills would be reduced if the delivery of the blows had to be restricted in order to avoid injury. Additionally, the benefits of practicing would be minimized if blows could not be fully delivered. As can be readily understood, protective gear is the preferred solution.

In an attempt to provide effective protection for the participants, particularly for the head, a number of proposed protective devices have been designed and are available commercially. To achieve the primary objective of safety, any such device must afford superior protection to the wearer while not encumbering the wearer in any appreciable manner. Because of the strenuous activity by the wearer while using any such protective device, it must be light weight and cover only areas of the head requiring protection so as to minimize any weight burden while permitting maximum ventilation. Any such protective device must also allow freedom of vision and hearing as well as movement so that the user may effectively participate in the activity as intended.

Typical devices designed in an effort to achieve these objectives are described in the patent literature exemplified by U.S. Pat. Nos. 2,296,335 to Brady; 3,551,911 to Holder; 4,058,854 to Rhee; 4,068,323 to Gwon; and 4,279,038 to Bruckner. Each of those prior devices provides some protection to the wearer but at the same time causes some unnecessary inconvenience. Some of those devices combine protective foam with heavy, rigid material thus causing an added weight burden to the user without an equivalent benefit. Others cover more of the wearer's head than necessary which increases costs and unduly restricts desired ventilation. Yet others unnecessarily limit the wearer's vision, hearing or freedom of movement.

As illustrated by the large number of prior devices, continuing efforts are being made in an attempt to solve the problem of designing protective, light weight, unencumbering, economical headgears. None of the known devices, however, discloses or suggests the present inventive devices as claimed herein. The present invention achieves its purposes, objectives and advantages over the prior approaches through new, useful and unobvious devices, at a reasonable cost, and through the utilization of only readily available materials.

These purposes, objectives and advantages should be construed as merely illustrative of some of the more prominent features and applications of the present invention. Many other beneficial results can be attained by applying the disclosed invention in a different manner or by modifying the invention within the scope of the disclosure. Accordingly, other purposes, objects and advantages as well as a fuller understanding of the invention may be had by referring to the summary of the invention and detailed description describing the preferred embodiments in addition to the scope of the invention as defined by the claims taken in conjunction with the accompanying drawings.

SUMMARY OF THE INVENTION

The present invention is defined by the appended claims with the specific preferred embodiments shown in the attached Figures. For the purposes of summarizing the invention, the invention may be incorporated into an improved headgear for use by participants in martial arts activities and the like. The improved headgear includes a circumferential member with a top edge and with a bottom edge. It is formed of foam covered by a pliable casing and shaped to encompass the head of the wearer. The member includes a narrow imperforate extent across the wearer's forehead, a wide partially perforate extent across the back of the wearer's head and intermediate perforate extents across the sides of the wearer's head for coupling the wide extent and narrow extent. The member also includes ear protectors downwardly extending from the intermediate extents. The member generally conforms to the wearer's head and is formed with apertures for providing ventilation to the wearer. The member also includes an imperforate area formed in the interior of the wide extent and shaped to form a concave region of entrapped air to absorb the force of a blow to the back of the wearer's head headgear also includes support means extending across the top edges and coupling opposed intermediate extents. Further, the headgear also includes a chin strap extendable beneath the chin of a wearer for releaseably coupling the the ear protectors. The support means may be a protective piece of foam covered by a pliable casing. In the alternative, the support means may be an inextensible strap. The improved headgear may further include, for each ear protector, an enlarged opening for receiving a wearer's ear, a protective foam ear covering on the exterior of the member overlying the opening and channel means formed in the interior of the member coupling the opening with adjacent apertures.

In addition, the invention may be incorporated into a headgear for protecting the head of a wearer against the force of a blow. The headgear comprises a resilient, conformable, energy absorbing member constructed of foam covered by a pliable casing. The member includes a circumferential band adapted to encompass the head of the wearer with front, back and side portions. The member also includes ear protectors downwardly extending from the side portions. The member is formed with apertures for ventilating the wearer. The headgear also includes a strap extendable beneath the chin of a wearer releaseably coupling the ear protectors. The ear protectors include enlarged openings for receiving a wearer's ears, coverings on the exterior of the member overlying the openings, and channel means formed in the interior of the member coupling the openings with adjacent apertures. The headgear coverings are apertured. Each channel means includes essentially horizontal channels extending from the opening and terminating at apertures horizontally to the sides of the opening.

BRIEF DESCRIPTION OF THE DRAWINGS

For a more complete understanding of the nature, objects and advantages of the present invention, reference should be had to the following detailed description, taken in conjunction with the accompanying drawings in which.

DETAILED DESCRIPTION OF THE INVENTION

Figure 1:
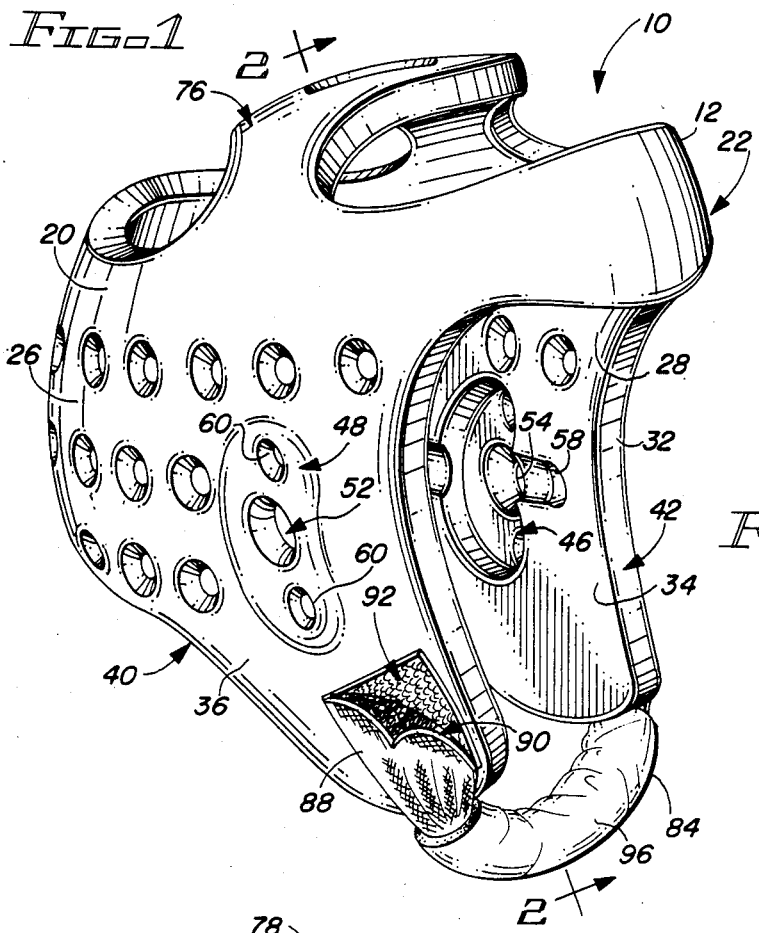
FIG. 1 is a right-front perspective view of a headgear constituting the first or primary embodiment of the present invention.
Figure 3:
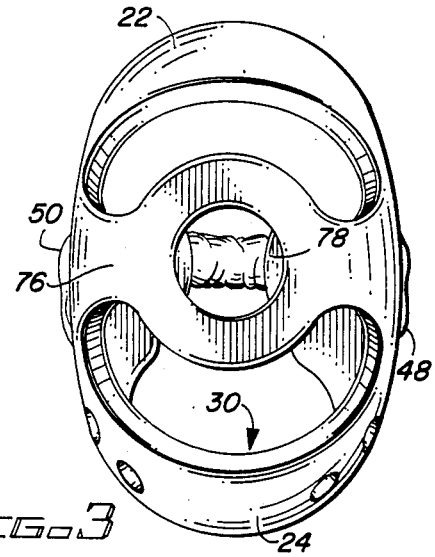
FIG. 3 is a top plan view of the headgear shown in FIGS. 1 and 2.

The protective headgear 10 shown in FIGS. 1 through 4 illustrate the first or primary embodiment of the present invention. A secondary or alternate embodiment of the invention is shown in FIGS. 6 through 9. Due to the great number of similarities between the two embodiments of the present invention, the description of the first embodiment is largely applicable to the second embodiment. Consequently, the two embodiments will be described jointly with similar descriptions and similar reference numerals being used for like parts. Differences between the two embodiments will be specifically noted.

Figure 5:
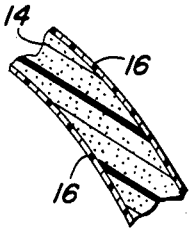
FIG. 5 is a cross-sectional view of a portion of the improved headgear illustrating the sandwiching of the closed cell foam material between coverings of a flexible plastic material.

The principal component of the headgear of both embodiments is a main body portion 12. The main body portion is fabricated of a suitable material 14, conformable and resilient as well as capable of absorbing energy when contacted and deformed by a blow. Preferred materials include elastomers such as a closed cell polyurethane foam or the like. As shown in FIG. 5, the foam material 14 is preferably provided with a suitable, pliable surface coating or casing 16 which entirely covers the surface of the foam material. The coating may be applied to the foam material by painting, dipping or other method of application. A tough, rugged, pliable plastic such as polyvinyl chloride has been found to be a preferred material for the coating. The portions of the headgear are preferably cut to shape while in a flat form. After cutting, the pieces are glued together and then shaped to the desired form while the coating is applied and dried. The dried coating retains the foam in the desired shape, curved to conform to the wearer's head. Supplemental straps indicia, or the like may finally be applied.

The main body portion of the headgear includes a circumferential strip or band 20 adapted to encompass and essentially conform to the head of the wearer. The band includes a first or narrow imperforate portion or extent 22 positionable across the wearer's forehead, a second or wide partially perforate portion or extent 24 positionable across the back of the wearer's head, and side or intermediate perforate portions or extents 26 and 28 positionable across the sides of the wearer's head and temples. The side or intermediate portions couple the wide portion 24 and narrow portion 22 to create a continuous top edge 30 and a continuous bottom edge 32. The foam portion and headgear also create an interior surface 34 and an exterior surface 36. The portions all function as a single, improved device, resilient and conformable to the head of a wearer and capable of absorbing energy to thereby protect the head of a wearer against blows.

The main body portion or foam member 12 also includes integrally formed ear protectors 40 and 42 of coated foam extending or projecting downwardly from the side or intermediate portions 26 and 28. In the illustrative embodiment of FIGS. 1–4, each ear protector includes an enlarged, generally oval, opening 46 for overlaying a portion of a wearer's ear. Each enlarged opening is provided with a generally protective oval covering 48 and 50 glued or otherwise secured to the exterior of the headgear, overlying the opening and constructed of a size slightly larger than the opening it covers. Each covering preferrably includes an aperture 52, 54 so as not to encumber the hearing of the wearer.

Figure 7:
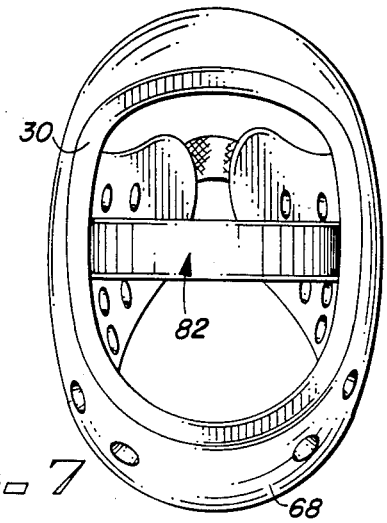
FIG. 7 is a top plan view of the headgear shown in FIG. 6.
Figure 2:
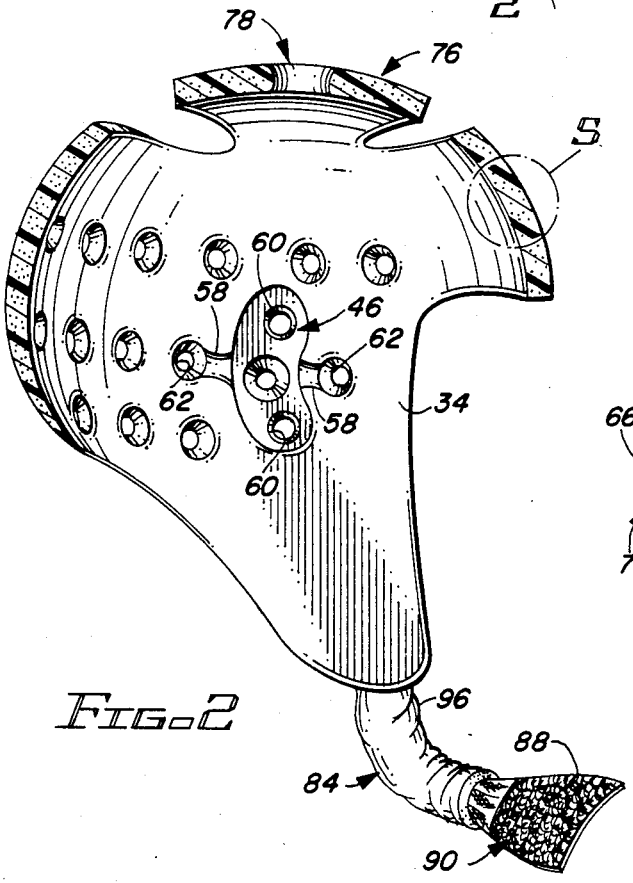
FIG. 2 is a sectional view of the headgear shown in FIG. 1.
Figure 4:
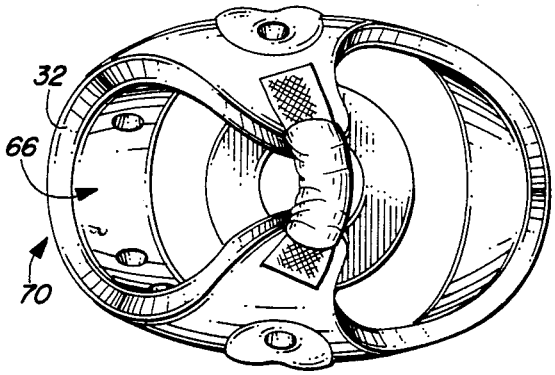
FIG. 4, is a bottom plan view of the headgear shown in FIGS. 1–3.
Figure 6:
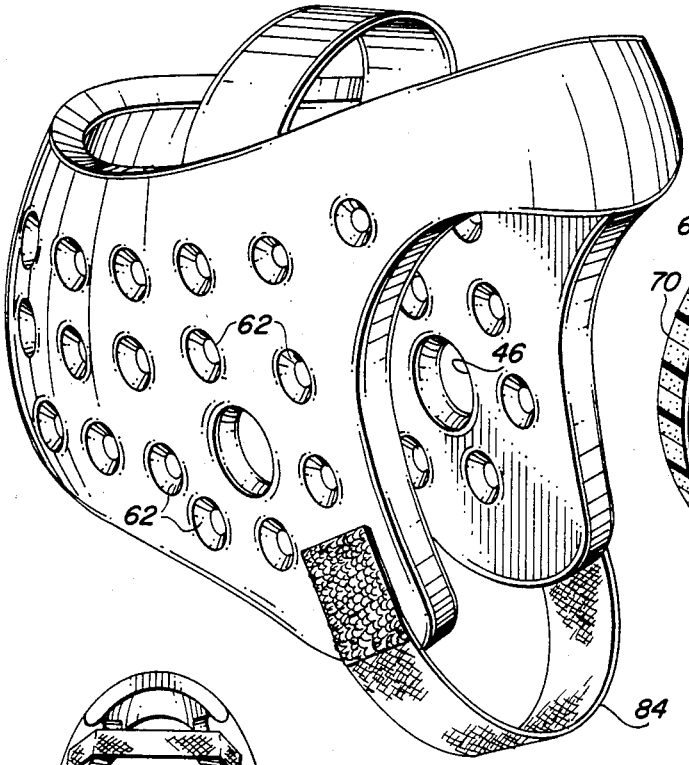
FIG. 6 is a right-front perspective view of a headgear constituting a second or alternate embodiment of the present invention.
Figure 9:
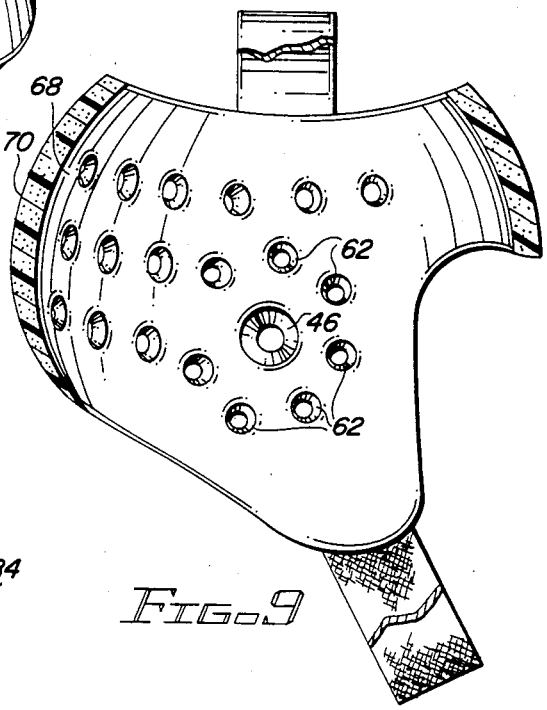
FIG. 9 is a sectional view of the headgear shown in FIGS. 6–8.
Figure 8:
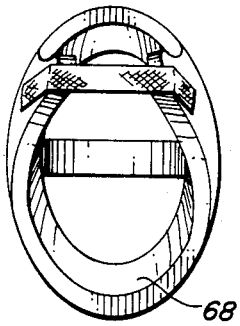
FIG. 8 is a bottom plan view of the headgear shown in FIGS. 6 and 7.

To prevent hearing damage to the wearer from blow to the ears channels 58 are formed in the interior of the headgear for pneumatically coupling each ear opening 46 with adjacent, horizontally displaced, apertures 62. Each opening 46 preferably includes generally horizontal channels 58 radiating outwardly from the sides of each opening and extending to the adjacent apertures 62 on each side of each opening. The openings 46 extend vertically a sufficient distance to pneumatically couple with apertures 60 in the coverings 48 and 50. Without such apertures and channels, there would be a tendency for a blow to a wearer's ear to block the opening thereby compressing the entrapped air into the wearer's ear with attendant damage to the eardrum. The apertures and channels thus provide conduits for guiding the entrapped air to the exterior of the headgear through adjacent apertures. Depending upon the size and position of openings 46 air pressure relief may be provided by clusters of apertures closely positioned about the ear openings. Clustering of apertures 62 about an ear opening 46 is best seen in FIGS. 6–7 in which the aperture 46 is not enlarged to the extent illustrated in FIGS. 1–2. While apertures 46 are larger than apertures 62, they are still smaller than the ear and depend upon apertures 62 to relieve air pressure when struck.

The main body portion of the headgear has holes, perforations or apertures 62 on both side portions, in the ear protectors, and in part of the back portion. The apertures are provided to increase ventilation. The portion covering the back of the wearer's head is partially perforate with apertures around its edges but with the central area 66 being imperforate, having no holes or apertures in it, so as to form a dome-shaped pocket 68 of air to help increase the ability of the headgear to absorb the force of a blow in that region, through penumatic compression of the air in the pocket 68.

The air pocket 68 is dome-shaped and results in a slight protuberance 70, visible from the exterior back side of the headgear. Although the headpiece generally conforms to the shape of the wearer's head, this back region is an exception since it has been found that such entrapped air assists in relieving the force of a blow to this area of a wearer's head. It cushions blows either when the wearer is struck by an opponent or when the wearer falls backwards and strikes the back of his head.

The foam member functions as a single integrally formed member. It is preferably formed, however, of two similarly shaped halves glued together along lines of junction vertically extending at the front and at the rear of the headpiece.

A protective foam strip 76, generally circular in shape, and formed with a central aperture 78, is provided in the headgear of the primary embodiment. The foam is coated as the rest of the headgear and provides additional protection to the wearer at the top of his head. It extends from the top edge of one intermediate or side portion of the foam member to the opposite side of the top edge. In the second or alternate embodiment, a simple, flexible, inextensible strap 82 is provided and is attached to the foam member in the same location as the strip of the first embodiment. The positioning of the strip and strap of these two embodiments, being across the top of a wearer's head prevents the headgear from being pulled down too low to be an effective protective device and from falling into the wearer's eyes to encumber the wearer's vision.

Lastly, a chin strap 84 is provided for positioning under the chin of a wearer to prevent the headgear from slipping up or around the face of the wearer. The chin strap may be of the same design for both embodiments of the present invention. It is formed of an elastic material and is attached by gluing or stitching at its one end 86 to the lower edge of an ear protector. The other end 88 of the strap includes a pile-type fastener 90 attachable to a mating pile-type fastener 92 glued or stitched to the lower edge of the other ear protector. The pile-type fasteners are commercially available under the tradename Velcro. Attachment and separation of the fastener allows donning and removal of the headgear. A tube 96 of coated foam material may be used to encompass the chin strap for added protection and comfort.

The invention is described herein with particular application to karate and other martial art sports. Those skilled in the art, however, will recognize the wider applicability of the inventive principles described herein.

While the present invention has been described herein with respect to two particular embodiments, many modifications and variations will become apparent to those skilled in the art. Accordingly, all such variations and modifications are intended to be included within the scope of the appended claims.

What is claimed is:

1. For use by participants in martial arts activities or the like, an improved headgear including:

a circumferential member with a top edge and with a bottom edge and formed of foam covered by a pliable casing and shaped to encompass the head of the wearer, the member including a narrow imperforate extent across the wearer's forehead, a wide partially perforate extent across the back of the wearer's head and intermediate perforate extents across the sides of the wearer's head and coupling the wide extent and narrow extent, the member also including ear protectors downwardly extending from the intermediate extents, the member generally conforming to the head of the wearer and being formed with apertures for providing ventilation to the wearer, the member also including an imperforate area formed in the interior of the wide extent and shaped to form a concave region of entrapped air to absorb the force of a blow to the back of the head of a wearer;

support means extending between and coupling opposed intermediate extents at top edge thereof; and a chin strap extendable beneath the chin of a wearer for releasably coupling the ear protectors.

2. The improved headgear as set forth in claim 1 wherein the support means is a protective piece of foam covered by a pliable casing.

3. The improved headgear as set forth in claim 1 and further including, for each ear protector, an enlarged opening positioned for overlaying at least a portion of a wearer's ear, a protective foam ear covering on the exterior of the member overlying the opening, and channel means formed in the interior of the member coupling the opening with adjacent apertures.

4. The improved headgear as set forth in claim 1 wherein the support means is an inextensible strap.

5. A headgear for protecting the head of a wearer against the force of a blow comprising a resilient, conformable, energy absorbing member constructed of a foam covered by a pliable casing, the member including a circumferential band adapted to encompass to head of the wearer with front, back and side portions, the member also including ear protectors downwardly extending from the side portions, the member being formed with apertures for providing ventilation therethrough, the headgear also including a strap extendable beneath the chin of a wearer releasable coupling the ear protectors, the ear protectors including enlarged openings overlaying at least a portion of a wearer's ears, protective coverings on the exterior of the member overlying the openings and venting means formed in the member for venting air pressure from the enlarged openings, the protective coverings being apertured and the venting means comprising at least one channel interior of the headgear extending from each enlarged opening and terminating at an aperture adjacent to each opening.

6. The headgear as set forth in claim 5 and including a plurality of apertures clustered about each enlarged opening for providing air pressure relief adjacent the wearer's ears.

7. The headgear as set forth in claim 5 wherein the circumferential band includes an imperforate area for positioning adjacent the back of the head of the wearer, the imperforate area being shaped to form a concave region for entrapping air between the headgear and head for providing additional absorption capability for blows to the back of the head.

* * * * *